United States Patent [19]

Jameson

[11] Patent Number: 4,625,782

[45] Date of Patent: Dec. 2, 1986

[54] LOG SPLITTER

[76] Inventor: Gary O. Jameson, RD #1, Box 200, Middle Grove, N.Y. 12850

[21] Appl. No.: 762,689

[22] Filed: Aug. 5, 1985

[51] Int. Cl.[4] ..... B27L 7/00

[52] U.S. Cl. ..... 144/193 R; 83/666; 83/672; 144/193 D

[58] Field of Search ..... 144/3 K, 2 R, 193 R, 144/193 D, 34 E, 188; 83/666, 672, 675

[56] References Cited

U.S. PATENT DOCUMENTS

| | | | |
|---|---|---|---|
| 1,895,048 | 1/1933 | Rose | 83/666 |
| 3,799,013 | 3/1974 | Long, et al. | 83/672 |
| 3,814,152 | 6/1974 | Pallari | 144/2 N |
| 3,969,966 | 7/1976 | Dillon | 83/672 |
| 4,053,004 | 10/1977 | Barwise et al. | 144/162 R |
| 4,106,537 | 8/1978 | Saikku | 144/34 E |
| 4,199,015 | 4/1980 | Doering | 144/193 A |
| 4,282,910 | 8/1981 | Kipela et al. | 144/3 K |
| 4,313,480 | 2/1982 | Pontelin | 144/193 R |
| 4,364,423 | 12/1982 | Schilling | 144/366 |
| 4,378,825 | 4/1983 | Schroeder | 144/193 R |

FOREIGN PATENT DOCUMENTS 1423164 11/1970 Fed. Rep. of Germany ..... 144/3 K

*Primary Examiner*—W. D. Bray

*Attorney, Agent, or Firm*—Heslin & Rothenberg

[57] ABSTRACT

A log splitting machine having a disk-like blade rotatable about an axis and able to split a log in a single 360° rotation about said axis. The blade has two parts, each of which performs a different function. The first part of the blade has a spiral-shaped cutting edge designed to sufficiently penetrate into an end of a log to be split so as to form a lengthwise crack in the log. The second part of the blade has a widening edge designed to separate the log into two pieces along the lengthwise crack with further rotation of the blade. The log splitting machine also includes: an adjustable backstop for accommodating logs of different length; a frame for supporting the blade, log and adjustable backstop; an electric motor for powering the blade through a 360° rotation; and a hood covering the blade and motor, and a deadman control switch for increased operator safety.

26 Claims, 10 Drawing Figures

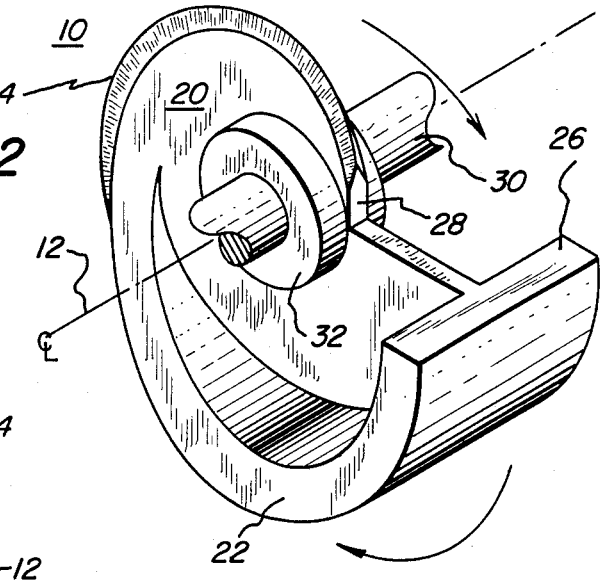
FIG. 2
FIG. 3
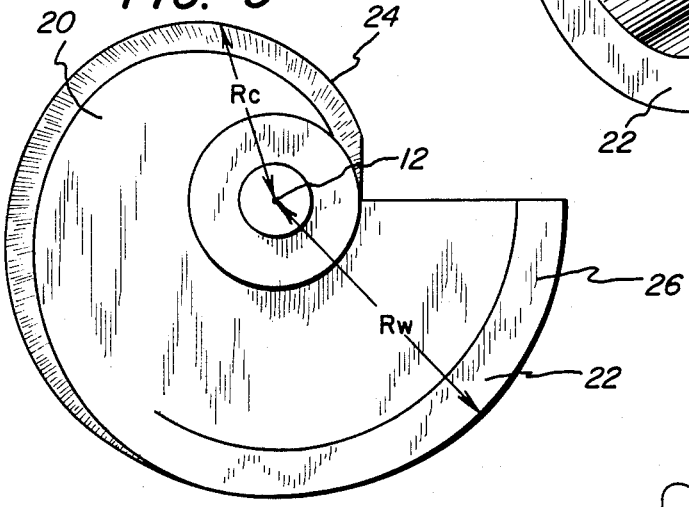
FIG. 4
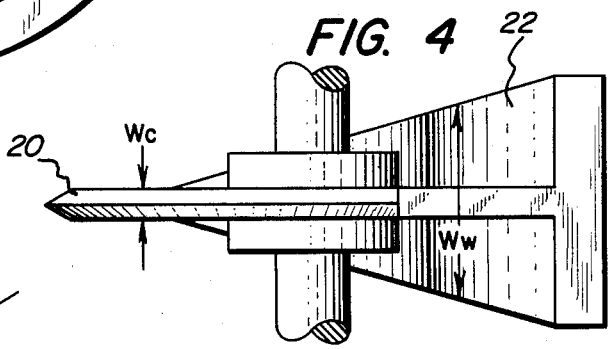
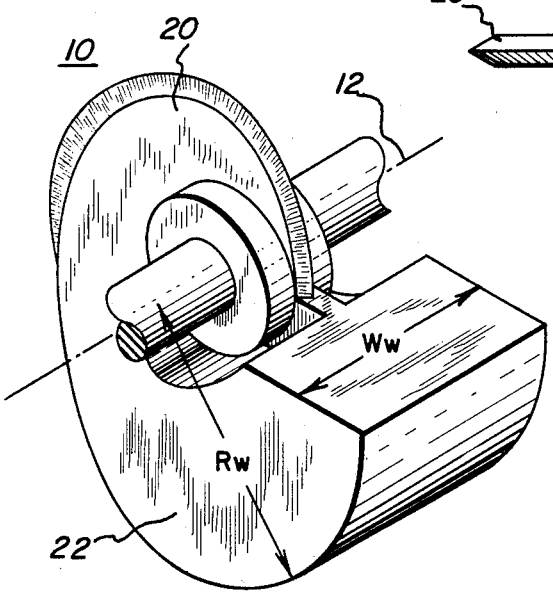
FIG. 5

LOG SPLITTER

BACKGROUND OF THE INVENTION

1. Field of the Invention

The present invention relates in general to log splitting machines and more particularly to a blade for such machines which is rotatable about an axis and able to split a log in a single 360° rotation about said axis.

2. Description of the Prior Art

Logs must be split in order to be effectively and economically used as firewood. The majority of motorized log splitting machines known today are designed to operate by forcing a log against a wedge with a ram. Typically, the ram is hydraulically driven and the motor is gasoline powered. Such log splitting machines exhibit a number of disadvantages. For example, the operator of such a machine frequently must steady the log to be split which creates the possibility of a trapped hand between the log and the ram or wedge when the power is applied. The ram in these log splitting machines usually requires about twenty seconds to cycle from a retracted position to an advanced position and back again. Also, these machines are often long and heavy due to the length and weight of the ram. Gasoline powered log splitters have the further undesirable features of being loud and air polluting.

Thus, there presently exists a genuine need for a safe, effective, fast, quiet, pollution-free, relatively small, easy to use, automatic log splitting machine.

SUMMARY OF THE INVENTION

The present invention satisfies these needs by providing a log splitting machine with a unique functional design. Central to the present invention, is a blade which is rotatable about an axis and able to split a log in a single 360° rotation about said axis. The blade comprises a disk-like member having two parts, each of which performs a different function. The first part of the disk-like member has a spiral-shaped cutting edge. The spiral-shaped cutting edge is designed to sufficiently penetrate into an end of a log to be split so as to form a lengthwise crack in the log. The second part of the disk-like member has a widening edge and is subsequent to, and integral with, the first part. With further rotation of the blade the widening edge is designed to separate the log into two pieces along the lengthwise crack.

Along with the unique blade, the present invention contemplates: an adjustable backstop for accommodating logs of different length; a frame for supporting the blade, log and adjustable backstop; an electric motor for powering the blade through a 360° rotation; and a hood covering the blade and motor, and a deadman control switch for increased operator safety.

A principle object of the present invention is the provision of a log splitting blade rotatable about an axis and able to split a log in a single 360° rotation about said axis.

Another object of the present invention is the provision of a relatively fast operating log splitting machine which increases an operator's log splitting productivity.

A further object of the present invention is the provision of such a log splitting machine which is relatively small, easy to use, and automatic.

A still further object of the present invention is the provision of such a log splitting machine which is quiet, pollution-free and operable in an enclosed space.

Yet another object of the present invention is the provision of such a log splitting machine which is also safe to use and easy to move.

Still another object of the present invention is the provision of such a log splitting machine which readily accommodates logs of different lengths and requires less frequent cutting edge sharpening.

BRIEF DESCRIPTION OF THE DRAWINGS

For a more complete understanding of the present invention and the advantages thereof, reference is now made to the following description taken in conjunction with the accompanying drawings in which:

FIG. 2 is a perspective view of the blade of the present invention.

FIG. 3 is an elevational view of the blade of the present invention.

FIG. 4 is a top plan view of the blade of the present invention.

FIG. 5 is a perspective view of an alternate embodiment of the blade of the present invention.

DETAILED DESCRIPTION OF THE INVENTION

Figure 1:
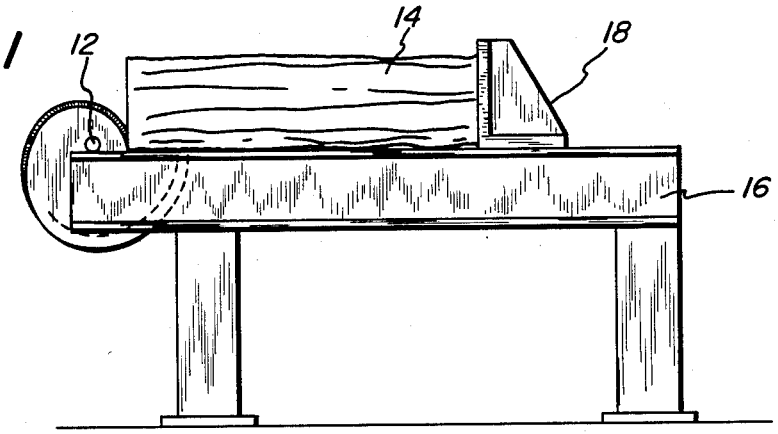
FIG. 1 is an elevational view depicting major functional elements of the present invention.
Figure 1A:
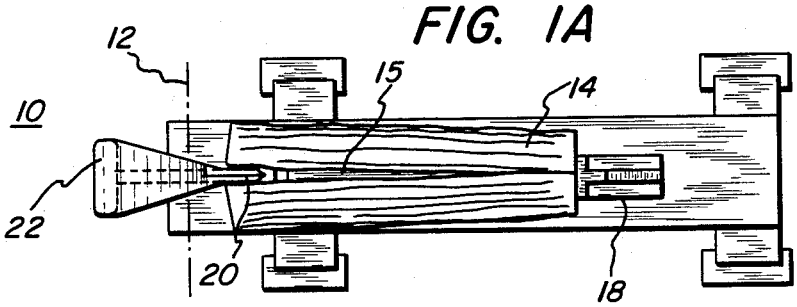
FIG. 1A is a top plan view of the embodiment of FIG. 1 showing the blade of the present invention partially rotated into the log so as to form a lengthwise crack in the log.
Figure 1B:
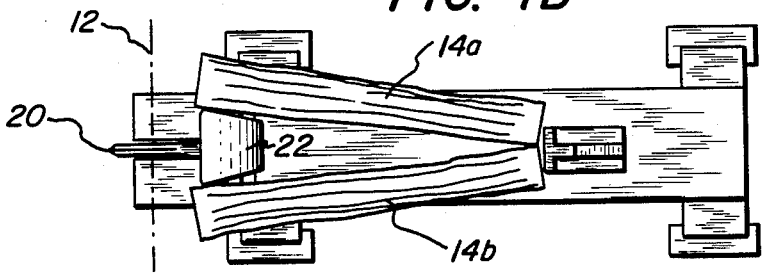
FIG. 1B is a top plan view of the embodiment of FIG. 1 showing the blade of the present invention further rotated into the log so as to separate the log into two pieces along the lengthwise crack.

The function of major elements of the present invention will now be described with reference to FIGS. 1, 1A and 1B. In FIG. 1, a disk-like blade, generally denoted as 10, having an axis of rotation 12 is shown at one end of frame 16. A log 14 is positioned on frame 16 so as to have one end in contact with blade 10 and an opposite end in contact with an adjustable backstop 18. As shown in FIG. 1A, and as discussed in more detail below, a first part 20 of blade 10 sufficiently penetrates into log 14 with clockwise rotation of blade 10 so as to form a lengthwise crack 15 in log 14. A second part 22 of blade 10, subsequent to and integral with first part 20, follows first part 20 into log 14 with further clockwise rotation of blade 10, and separates log 14 into two pieces **14*a* & 14*b* along lengthwise crack 15, as shown in FIG. 1B. The present invention thus accomplishes the splitting of a log with only one 360° rotation of blade 10**.

A preferred embodiment of blade 10 is shown in perspective in FIG. 2. The first part 20 encompasses approximately two thirds of blade 10 and comprises a cutting portion having a cutting edge 24. As depicted in FIG. 3, cutting edge 24 has a radial length $R_c$ from the axis of rotation 12 of blade 10 which increases in a direction opposite (counter clockwise) to the direction of rotation of the blade (clockwise) so as to give first part 20 of blade 10 a spiral-shaped form. The width $W_c$ of first part 20 remains substantially constant as indicated in FIG. 4.

Referring back to FIG. 2, it can be observed that the second part 22 encompasses approximately one-third of blade 10 and comprises a wedge portion having a widening edge 26. Widening edge 26 has a substantially constant radial length $R_w$ from the axis of rotation 12 of blade 10 as shown in FIG. 3. It can be seen with reference to FIGS. 2 & 4 that widening edge 26 increases in width in a direction opposite (counter clockwise) to the direction of rotation of the blade (clockwise).

In practice, blade 10 will be connected to an axle 30 as shown in FIG. 2. The connection of blade 10 to axle 30 may be accomplished by any known means. In the preferred embodiment, a standard key arrangement is used to attach blade 10 to axle 30. As shown, a boss 32 is preferably added to both sides of blade 10. Boss 32 provides a longer key way for the connection of blade 10 to axle 30 and also serves to give radial support to blade 10. Also shown in FIG. 2 is a relatively small notched portion 28 forming a 90° cutout between the end of second part 22 and the beginning of first part 20. This cutout provides for ready, initial placement of log 14 against blade 10.

By way of example, blade 10 may have the following dimensions: a first part radial length $R_c$ which increases from an initial length of 3 inches to a final length of 6 inches; a second part radial length $R_w$ of 6 inches; a constant first part width $W_c$ of $\frac{1}{2}$ inch; a second part wedge width $W_w$ which increases from an initial width of $\frac{1}{2}$ inch to a final width of $4\frac{1}{2}$ inches; and bosses as discussed above, of 3 inches in radius on either side of blade 10.

An important and unexpected side benefit of the present invention was realized during prototype testing. Blade 10 has successfully split numerous cords of wood without requiring sharpening of cutting edge 24. The greatest amount of work done by log splitting machine 40 (see FIG. 6) occurs within the initial $\frac{1}{3}$ rotation of blade 10, prior to the formation of lengthwise crack 15 in log 14 (see FIG. 1B). Once lengthwise crack 15 forms, dulling pressures on cutting edge 24 dissipate and further rotation of blade 10 in log 14 will tend to maintain the sharpness of cutting edge 24. Preferably, blade 10 will be forged from either a hard or cold rolled steel.

An alternate embodiment of blade 10 is shown in FIG. 5. In this embodiment, second part 22 of blade 10 has a constant radial length $R_w$ as in the preferred embodiment. However, the widening portion $W_w$ of second part 22 extends over a greater radial length $R_w$ of second part 22, as shown in FIG. 5. In the preferred embodiment, as noted above, second part 22 has only widening edge 26 since this is sufficient to successfully separate log 14 into two pieces along lengthwise crack 15.

Figure 6:
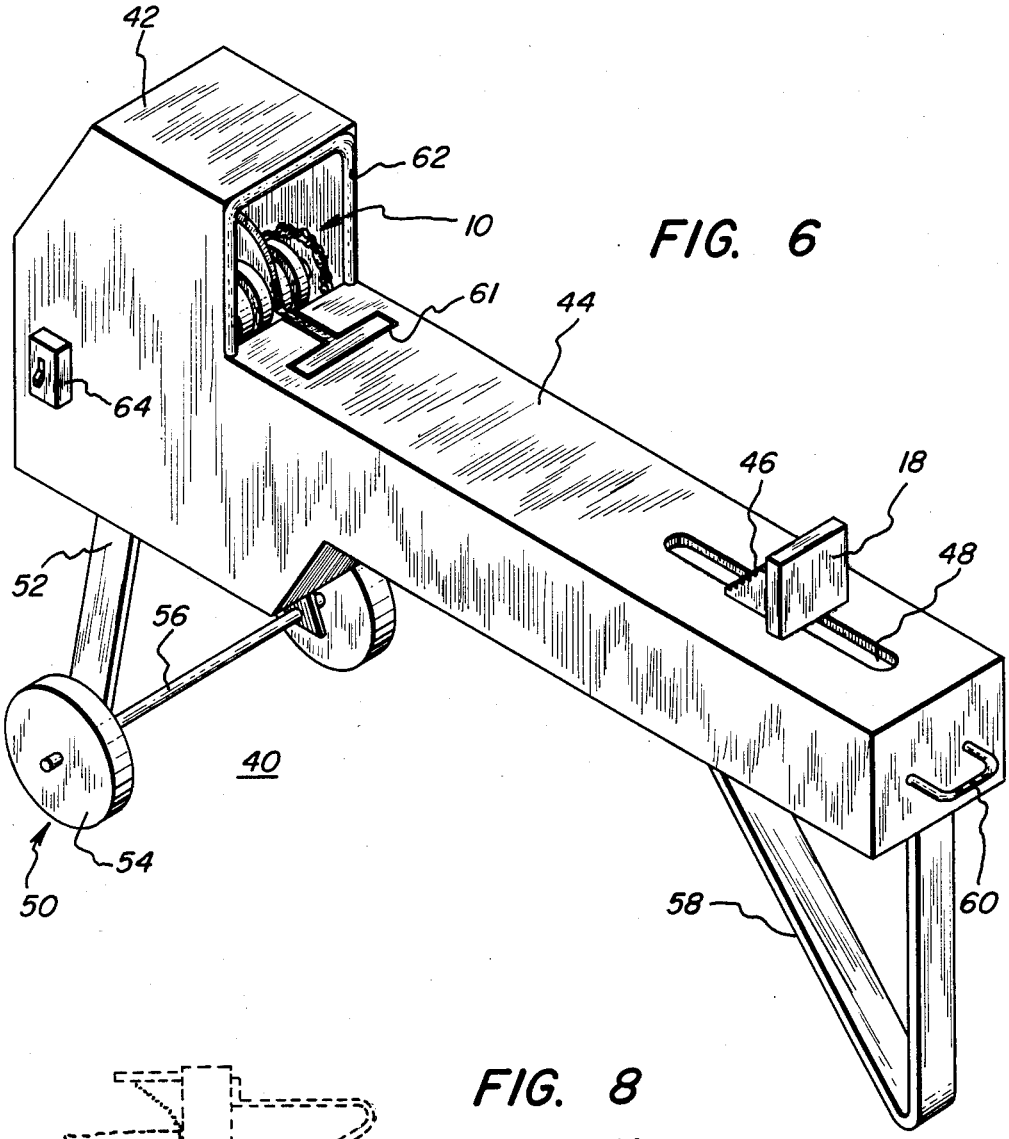
FIG. 6 is a perspective view of the log splitting machine of the present invention.

The preferred embodiment of the log splitting machine of the present invention, generally denoted as 40, is shown in FIG. 6. Log splitting machine 40 has a frame body 44 upon which a log to be split is placed. Blade 10 is located at one end of frame body 44 and adjustable backstop 18 is located near the other end. A hood 42 covers most of blade 10 and the means for rotating blade 10. A T-shaped cutout 61 in frame body 44 accomodates the rotation of blade 10. Adjustable backstop 18 is horizontally reciprocally operable between a forward and a retracted position within an adjustment range defined by frame cut-out 48 as needed depending upon the length of the log to be split. Additionally, adjustable backstop 18 preferably has an angled rasp-like surface 46 facing and contacting the log to be split. The angled rasp-like surface 46 allows an operator to split logs of varying lengths without adjusting backstop 18 for each log to be split.

Frame body 44 is supported at one end by a standard wheel assembly generally denoted as 50. The wheel assembly 50 has legs 52 connected to a transverse axle 56 which has wheels 54 at opposite ends thereof. Frame body 44 is supported at the other end by a fixed leg 58 having a V-shape for increased support strength and stability of log splitting machine 40. A handle 60 is attached to the same end of frame body 44 as fixed leg 58. Handle 60 is provided to facilitate movement of log splitting machine 40 by the operator either to a different location or to a different storage/operation position, as described in more detail below. Lastly, it can be observed from FIG. 6 that a U-shaped bar 62 is attached to the open portion of hood 42. Should blade 10 become caught in a log being split, the operator may reverse rotation of blade 10 causing the log to lift up and impact against U-shaped bar 62 and in so doing free blade 10.

Figure 7:
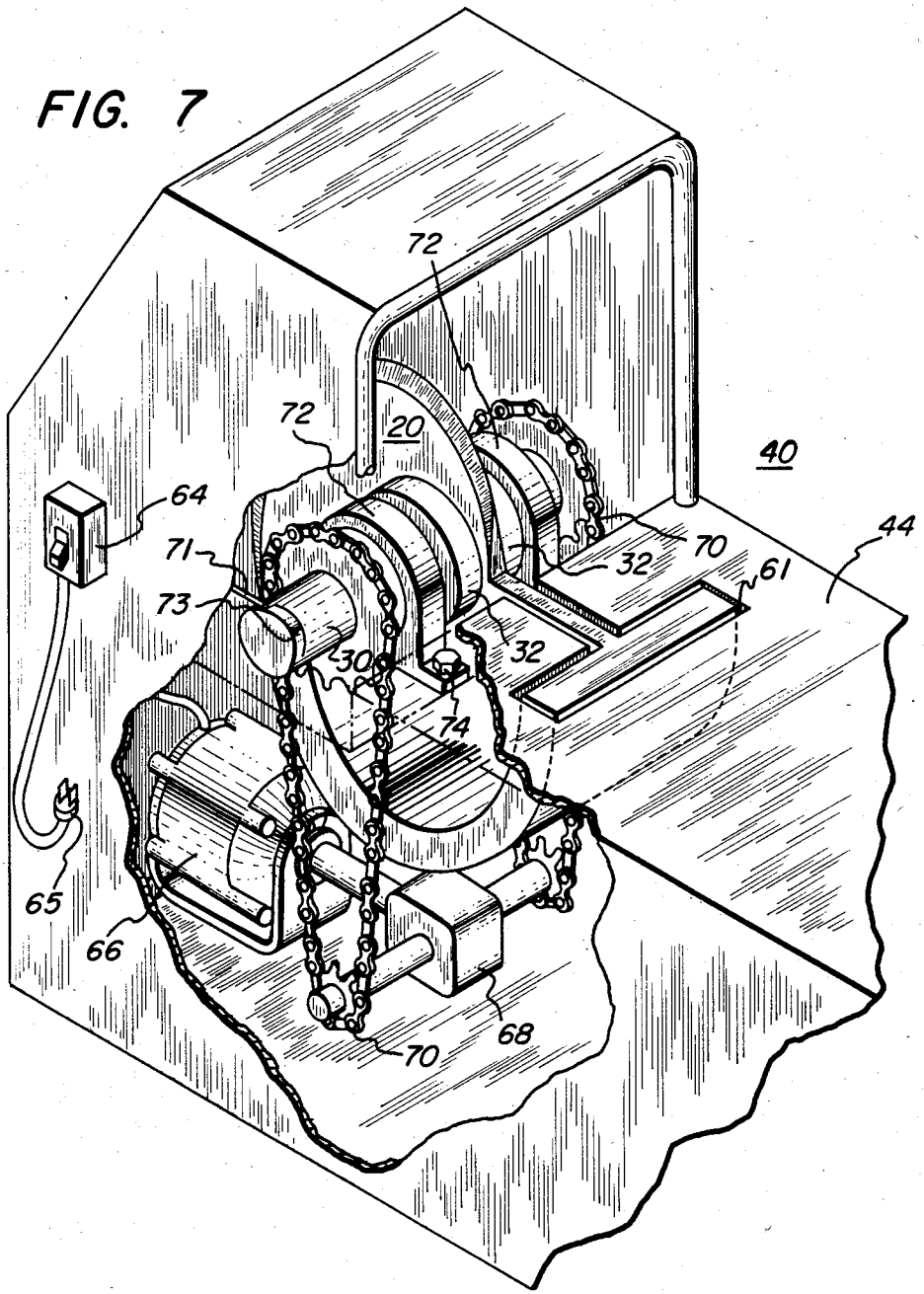
FIG. 7 is an enlarged partial view of the log splitting machine of the present invention.

Referring to FIG. 7, an enlarged, cut-away partial view of log splitting machine 40 is shown. An operator may cycle blade 10 once by pressing switch 64 which will result in energizing the means for rotating blade 10. At one end of axle 30 is a cam 73 which is engaged by a cam follower 71. Upon completion of one cycle, cam follower 71 causes the means for rotating blade 10 to be de-energized. Switch 64 will preferably contain a dead man control feature and may be located in any appropriate position on frame body 44 or may be a hand held or foot controlled device. In the preferred embodiment of the present invention, the means for rotating blade 10 will be electrically driven. However, it should be understood that alternate rotating means, such as a gasoline powered engine, may be used without departing from the spirit of the present invention.

Preferrably, an 110-V electric motor 66, having approximately a 1 H.P., 1725-RPMs rated output, will be energized by inserting plug 65 into any standard household outlet. The 1725 RPMs rated output of 110-V electric motor 66 will be reduced via a standard gear box 68 to approximately 6 RPMs. The preferred rotational speed of 6 RPMs will allow blade 10 to complete a 360° cycle in approximately 10 seconds, a fast yet acceptable and safe operating speed. The 6 RPMs output of gear box 68 will be transferred to axle 30 of blade 10 via a dual drive chain assembly 70. The combination of blade 10 and axle 30 is held in place by traditional pillow blocks with bearings 72 on each side of blade 10. Pillow blocks with bearings 72 are secured by bolts 74 to body frame 44.

Figure 8:
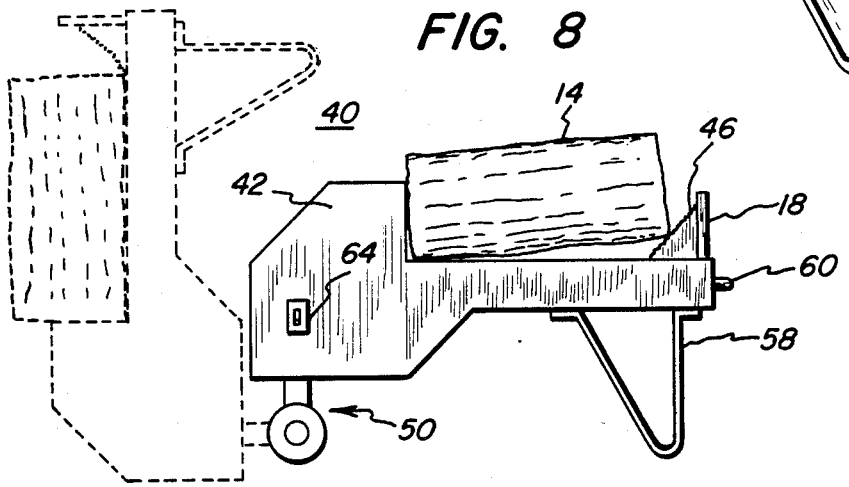
FIG. 8 is an elevational view of the log splitting machine of the present invention showing an optional storage/operation position in phantom.

The versatility of log splitting machine 40 is illustrated in FIG. 8. The log splitting machine may be operated or stored in either a horizontal or vertical position. Vertical positioning of log splitting machine 40 offers the advantages of occupying less storage space and of not requiring the operator to lift the log as high as when the log splitting machine is used in a horizontal position. Lastly, as noted earlier and as shown in the horizontal positioning of log splitting machine 40 in FIG. 8, a rasp-like surface 46 on backstop 18 allows logs of varying length to be split without requiring the operator to continually adjust backstop 18.

It will be noted that this invention fully meets the objectives set forth. A log splitting blade rotatable about an axis is provided which may be used to split a log in a single 360° rotation about said axis. Also, it will be noted that the log splitting machine of the present invention is faster and smaller than traditional log splitting machines which utilize a ram. Additionally, it is evident that the electrically driven log splitting machine of the present invention is relatively quiet and pollution free. Lastly, it will be observed that the log splitting machine of the present invention is compact, versatile, safe to use, easy to move and requires less frequent blade sharpening.

Although one embodiment has been illustrated in the accompanying drawings and described in the foregoing detailed description, it will be understood that the invention is not limited to the embodiment discussed but is capable of numerous rearrangements, modifications, and substitutions without departing from the scope of the invention. For example, the blade might, under appropriate circumstances vary in size and dimensions from those given, or the adjustable backstop might be of a different construction. Other changes, within the scope of the invention as defined by the appended claims, will suggest themselves to those versed in this art.

What I claim is:

1. A blade, rotatable about an axis, for use in log splitting, said blade being positioned to engage an end of a log and being constructed so as to split the log in a single 360° rotation about said axis, comprising:

cutting means having a radius relative to said axis which increases with rotation of said blade such that upon rotation of said blade, said cutting means sufficiently penetrates the end of a log engaged by said blade to form a lengthwise crack in said log; and separating means of width which increases with rotation of said blade for separating the log into two pieces along said lengthwise crack, said separating means being integral with and subsequent to said cutting means.

2. The blade of claim 1, wherein said cutting means comprises a planar, spiral shaped cutting edge which penetrates into an end of the log to be split and wherein said separating means has a substantially constant radius relative to said axis.

3. The blade of claim 2, wherein said separating means has a wedge shape and wherein the substantially constant radius of said separating means is substantially equal to the maximum length of the radius of said cutting means.

4. The blade of claim 3, wherein the blade comprises a disk-like member and wherein said cutting means comprises a majority of said disk-like member and said separating means comprises a minority of said disk-like member.

5. The blade of claim 4, wherein said cutting means comprises a first sharpened edge portion of said disk-like member, said separating means comprises a second widening edge portion of the disk-like member and further including a third notched edge portion on the disk-like member for accommodating the end of a log to be split.

6. The blade of claim 5, wherein said notched edge portion is located between an end of the second edge portion and a beginning of the first edge portion and wherein said notched edge portion forms an angle of substantially 90°.

7. A log splitting blade mounted for rotation in a specified direction about an axis which extends through the blade, said blade having a first peripheral portion which is sharpened into a cutting edge, said edge lying in a plane substantially perpendicular to said axis, said edge having a contour that spirals out relative to said axis in a direction opposite to the direction of rotation of the blade, and said blade having a second peripheral portion which flares out from said plane and increases in width in a direction opposite to the direction of rotation of said blade, whereby, with the blade positioned to engage an end of a log, in a single rotation of said blade about the axis, the cutting edge penetrates sufficiently into the end of the log engaged by said blade to form a lengthwise crack in said log and said second portion separates the log into two pieces along said lengthwise crack.

8. The blade of claim 7, wherein said second peripheral portion comprises a curved surfce substantially uniformly spaced from said axis by a distance substantially equal to the maximum distance of said cutting edge from said axis.

9. The blade of claim 8, wherein said blade is rotatable in a direction reverse to said specified rotational direction so that the blade can be rotated free from said log if caught therein.

10. A rotatable blade for use in log splitting, comprising:

a disk-like member, said disk-like member being rotatable about an axis extending substantially perpendicularly through said member, said disk-like member being oriented in use to engage an end of a log to be split, said disk-like member having a first part, said first part having a curved sharpened edge, the radial distance of said edge from the axis increasing with rotation of the blade, said first part comprising cutting means for sufficiently penetrating an end of a log to be split so as to form a lengthwise crack in said log, and said disk-like member having a second part, said second part having a wedge shaped portion, the width of said wedge shaped portion increasing with rotation of the blade, said second part being integral with and subsequent to said first part and serving to separate the log into two pieces along said lengthwise crack.

11. The blade of claim 10, wherein said disk-like member further comprises a third part integral with said first and second parts and subsequent to said second part, said third part comprising means defining a cutout in the periphery of said disk-like member for receiving an end of a log to be split.

12. A blade, rotatable about an axis, for use in log splitting, said blade being positioned in use to engage an end of a log to be split, comprising:

a disk-like member, said disk-like member having a curved border, said border having a first part of increasing radius relative to said axis, said first part comprising a cutting edge for engaging an end of a log to be split, and said border having a second part of increasing width, the increase in radius of the first part and the increase in width of the second part occurring in a direction opposite to that in which the blade rotates, whereby, during a single rotation of the member, the first part sufficiently penetrates the end of the log to be split so as to form a lengthwise crack in said log and the second part separates the log into two pieces along said lengthwise crack.

13. The blade of claim 12, wherein said first part has a substantially constant width and said second part has a substantially constant radius relative to said axis.

14. The blade of claim 13 wherein the substantially constant radius of the second part is substantially equal to the final length of the increasing radius of the first part.

15. The blade of claim 14 wherein said disk-like member further includes two straight-edge border portions meeting at substantially 90° for receiving an end of the log to be split, said straight-edge border portions connecting an end of the second part of the curved border to a beginning of the first part of the curved border.

16. The blade of claim 15 wherein said first part encompasses at least one-third of the rotation of said blade about said axis and wherein said second part encompasses at least one-third of the rotation of said blade about said axis.

17. Log splitting apparatus, comprising:

a blade, rotatable about an axis extending through said blade, said blade being constructed so as to split a log in a single 360° rotation about said axis, said blade comprising cutting means having a radius relative to said axis which increases with initial rotation of said blade and separating means having a width which increases with subsequent rotation of said blade;

means for powering said blade through a 360° rotation; and means for holding an end of a log in engagement with said blade, whereby, during a single rotation of said blade, the cutting means penetrates sufficiently into the log to form a lengthwise crack in said log and said separating means separates the log into two pieces along said lengthwise crack.

18. The log splitting apparatus of claim 17 further comprising a frame for supporting said blade, powering means and holding means.

19. The log splitting apparatus of claim 18, wherein said log holding means comprises means for maintaining ends of logs of different lengths in engagement with said blade.

20. The log splitting apparatus of claim 19, wherein the holding means comprises a longitudinally adjustable, angled backstop for accommodating logs of different lengths.

21. The log splitting apparatus of claim 20, wherein said angled backstop comprises an angled portion having a rasp-like surface facing the blade.

22. The log splitting apparatus of claim 21, wherein said powering means comprises electric powering means including a cam operated switch for rotating said blade through a single 360° rotation about said axis.

23. The log splitting apparatus of claim 22, wherein said electric powering means further comprises a dead man control.

24. The log splitting apparatus of claim 23, wherein said cutting means comprises a spiral shaped cutting edge located in a plane substantially perpendicular to said axis, said separating means comprises a wedge shaped member, said separating means being integral with said cutting means, and said blade being mounted for rotation on an axle extending along said axis.

25. The log splitting apparatus of claim 24, wherein said blade further comprises means, located between an end of said separating means and a beginning of said cutting means, for initially receiving an end of a log to be split.

26. The log splitting apparatus of claim 25, wherein said frame is provided with wheels to facilitate movement of the apparatus, and a safety hood for covering a portion of said electric powering means and said blade.

* * * * *